US005274690A

United States Patent [19]

Burke et al.

[11] Patent Number: 5,274,690

[45] Date of Patent: Dec. 28, 1993

[54] ROTATING HOUSING AND ANODE/STATIONARY CATHODE X-RAY TUBE WITH MAGNETIC SUSCEPTOR FOR HOLDING THE CATHODE STATIONARY

[75] Inventors: James E. Burke, Villa Park; Lester Miller, Naperville; Salvatore G. Perno, Winfield, all of Ill.

[73] Assignee: Picker International, Inc., Highland Heights, Ohio

[21] Appl. No.: 988,403

[22] Filed: Dec. 9, 1992

Related U.S. Application Data

[63] Continuation-in-part of Ser. No. 817,294, Jan. 6, 1992, which is a continuation-in-part of Ser. No. 817,295, Jan. 6, 1992, Pat. No. 5,200,985, which is a continuation-in-part of Ser. No. 817,296, Jan. 6, 1992, which is a continuation-in-part of Ser. No. 862,805, Apr. 3, 1992.

[51] Int. Cl.[5] ..... H01J 35/06

[52] U.S. Cl. ..... 378/135; 378/132; 378/136

[58] Field of Search ..... 378/135, 136, 119, 121, 378/125, 127, 132, 143, 144

[56] References Cited

U.S. PATENT DOCUMENTS

| | | | |
|---|---|---|---|
| 2,111,412 | 3/1938 | Ungelenk | 250/35 |
| 3,852,605 | 12/1974 | Watanabe et al. | 250/401 |
| 4,045,672 | 8/1977 | Watanabe | 250/360 |
| 4,199,684 | 4/1980 | Leunbach et al. | 250/402 |
| 4,206,356 | 6/1980 | Wardley et al. | 250/402 |
| 4,250,425 | 2/1981 | Gabbay et al. | 313/60 |
| 4,417,171 | 11/1983 | Schmitmann | 313/16 |
| 4,521,900 | 6/1985 | Rand | 378/137 |
| 4,521,901 | 6/1985 | Rand | 378/138 |
| 4,531,226 | 7/1985 | Peschmann | 378/143 |
| 4,535,243 | 8/1985 | Peschmann | 250/363 |
| 4,573,179 | 2/1986 | Rutt | 378/10 |
| 4,610,021 | 9/1986 | Peschmann et al. | 378/150 |
| 4,618,970 | 10/1986 | Rand et al. | 378/10 |
| 4,621,213 | 11/1986 | Rand | 313/237 |
| 4,625,150 | 11/1986 | Rand | 315/111.3 |
| 4,631,741 | 12/1986 | Rand et al. | 378/10 |
| 4,644,168 | 2/1987 | Rand et al. | 250/398 |
| 4,672,649 | 6/1987 | Rutt | 378/10 |
| 4,736,396 | 4/1988 | Boyd et al. | 378/4 |
| 4,769,831 | 9/1988 | Broenner | 378/125 |
| 4,788,705 | 11/1988 | Anderson | 378/121 |
| 4,869,257 | 9/1989 | Molnar et al. | 128/660.1 |
| 4,878,235 | 10/1989 | Anderson | 378/136 |
| 4,914,681 | 4/1990 | Klingenbeck et al. | 378/12 |
| 4,944,448 | 7/1990 | Peschmann et al. | 228/173.2 |
| 5,046,186 | 9/1991 | Rohmfeld | 378/125 |
| 5,200,985 | 4/1993 | Miller | 378/735 |

*Primary Examiner*—David P. Porta

*Attorney, Agent, or Firm*—Fay, Sharpe, Beall, Fagan, Minnich & McKee

[57] ABSTRACT

An x-ray tube includes an anode (A) and envelope (C) which are rotated (D) at a relatively high rate of speed. A cathode assembly (B) is supported in the envelope on a bearing (32). In order to hold the cathode assembly stationary, a magnetic susceptor (40) having periodic projections (44) is disposed with the projections closely adjacent an outer peripheral wall (20) of the envelope. A plurality of permanent magnets (52) are mounted on a stationary keeper (50), each magnet adjacent one of the susceptor projections. Preferably, the magnets have alternating polarity such that magnetic flux lines (54) flow between adjacent magnets through the magnetic susceptor.

17 Claims, 6 Drawing Sheets

ROTATING HOUSING AND ANODE/STATIONARY CATHODE X-RAY TUBE WITH MAGNETIC SUSCEPTOR FOR HOLDING THE CATHODE STATIONARY

This application is a continuation-in-part of U.S. Application Ser. Nos. 07/817,294; 07/817,295 now U.S. Pat. No. 52,009; and 07/817,296, all filed Jan. 6, 1992 and U.S. Application Ser. No. 07/862,805, filed Apr. 3, 1992.

BACKGROUND OF THE INVENTION

The present invention relates to the x-ray tube art. It finds particular application in conjunction with high power x-ray tubes for use with CT scanners and the like and will be described with particular reference thereto. It will be appreciated, however, that the invention will also have other applications.

Typically, a high power x-ray tube includes an evacuated envelope or housing which holds cathode filament through which a heating current is passed. This current heats the filament sufficiently that a cloud of electrons is emitted, i.e. thermionic emission occurs. A high potential, on the order of 100–200 kV, is applied between the cathode and an anode which is also located in the evacuated envelope. This potential causes the electrons to flow from the cathode to the anode through the evacuated region in the interior of the evacuated envelope. The electron beam impinges on a small area of the anode or focal spot with sufficient energy that x-rays are generated and extreme heat is produced as a by-product.

In high energy x-ray tubes, the anode is rotated at a high speed such that the electron beam does not dwell on only the small spot of the anode long enough to cause thermal deformation. The diameter of the anode is sufficiently large that in one rotation of the anode, each spot on the anode that was heated by the electron beam has substantially cooled before returning to be reheated by the electron beam. Larger diameter anodes have larger circumferences, hence provide greater thermal loading. In conventional rotating anode x-ray tubes, the envelope and the cathode remain stationary while the anode rotates inside the envelope. Heat from the anode is dissipated by the thermal radiation through the vacuum to the exterior of the envelope. It is to be appreciated that heat transfer from the anode through the vacuum is limited.

High power x-ray tubes have been proposed in which the anode and vacuum envelope rotate, while the cathode filament inside the envelope remains stationary. This configuration permits a coolant fluid to be circulated through the anode to provide a direct thermal connection between the anode and the exterior of the envelope. See for example, U.S. Pat. Nos. 5,046,186; 4,788,705; 4,878,235; and 2,111,412.

One of the difficulties with this configuration is holding the cathode stationary within the rotating envelope. When the cathode assembly is supported by structures which are rotating with the envelope at a high rate of speed, it tends to rotate with the anode and the envelope.

One technique for holding the cathode stationary is through the use of magnets. One or more stationary magnets are mounted outside of the rotating envelope and couple with a magnetic structure inside the envelope connected with the cathode. One of the problems with these arrangements is that they lack stability and freedom from oscillation. Typically, the magnet assembly is at a relatively small diameter or lever arm. This short lever arm exaggerates the oscillation problem. The magnetic coupling is analogous to a spring. The rotational forces on the cathode tend to move the cathode away from the magnet. The magnet pulls the cathode structure back, but the cathode structure typically overshoots the magnet, going past it in the other direction. The magnet pulls the cathode structure back towards itself again but again there is a tendency to overshoot. In this manner, the cathode tends to oscillate back and forth. Frictional forces transmitted through the bearing or other structures which support the cathode within the envelope supply energy to restart or maintain such oscillations. Such oscillations, of course, oscillate the electron beam, hence the focal spot on the anode where x-rays are generated. This wavering of the focal point of the x-ray beam has detrimental effects, particularly in CT scanners and other high performance x-ray equipment.

The present invention provides a new and improved x-ray tube in which there is a stiff coupling between the electrode and stationary structures on the exterior of the rotating housing.

SUMMARY OF THE INVENTION

In accordance with the present invention, an x-ray tube is provided in which an evacuated envelope and a cathode contained therein undergo relative rotational movement. A magnetic susceptor having a multiplicity of alternating projections and recesses is connected with the cathode such that the projections are disposed closely adjacent to the rotating housing. A plurality of magnets are disposed exterior to the housing adjacent each of the susceptor projections. The magnets have alternating poles facing the susceptor to create magnetic flux loops which flow through the susceptor between adjacent projections.

In accordance with another aspect of the invention, a means is provided for damping oscillations of the cathode assembly.

In accordance with a more limited aspect of the present invention, at least two of the exterior magnets are electromagnets which are operating close to resonance. As a susceptor projection moves away from one of the electromagnets, its resonance frequency changes closer to the driven frequency, increasing the strength of the electromagnet and drawing the susceptor projection back. As the susceptor projection becomes closer to the other electromagnet, its resonance frequency changes, but further from resonance. This reduces its magnetic attraction.

As the number of exterior magnets increases and the magnets become closer together, the coupling stiffens but there is an increasing tendency for magnetic flux to pass directly between adjacent magnets without passing through the magnetic susceptor. In accordance with another aspect of the present invention, a blocking magnetic pole is disposed between adjacent exterior magnets to block the flow of magnetic flux directly therebetween.

In accordance with another aspect of the present invention, the magnetic susceptor is a high temperature ferromagnetic alloy with a scalloped outer surface defining the projections and recesses of the ferromagnetic, unmagnetized material.

In accordance with another more limited aspect of the present invention, the susceptor has substantially the same diameter as the rotating envelope.

One advantage of the present invention is that it minimizes oscillations.

Another advantage of the present invention is that it provides a stiff coupling between the stationary structure and the cathode.

Another advantage of the present invention is that it is self-adjusting to dampen any oscillations more quickly.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components and in various steps and arrangements of steps. The drawings are only for purposes of illustrating the preferred embodiments and are not to be construed as limiting the invention.

DETAILED DESCRIPTION OF THE PREFERRED EMBODIMENTS

Figure 1:
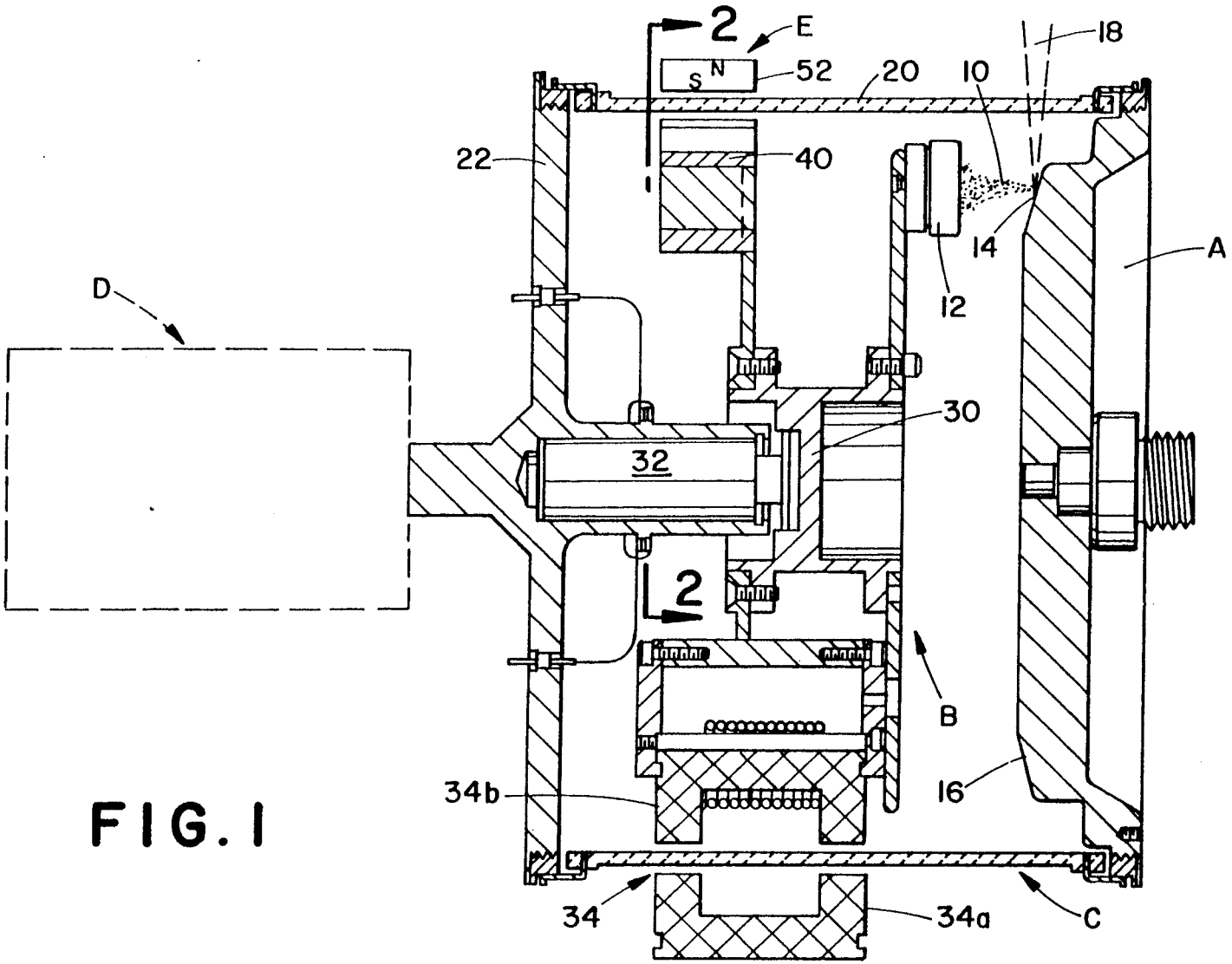
FIG. 1 is a transverse cross-sectional view of a rotating envelope and anode/stationary cathode x-ray tube in accordance with the present invention.

With reference to FIG. 1, an x-ray tube includes an anode A and a cathode assembly B. An evacuated envelope C is evacuated such that an electron beam 10 can pass from a cathode cup 12 to a focal spot 14 on an annular face 16 of the anode. A rotation means D rotates the anode A and the evacuated envelope C while a magnetic susceptor means E holds the cathode assembly B stationary.

The anode A is beveled adjacent its annular peripheral edge to define the anode surface 16 which is bombarded by the electron beam 10 to generate a beam 18 of x-rays. The entire anode may be machined from a single piece of tungsten. Alternately, the focal spot path along the anode surface may be defined by an annular strip of tungsten which is connected to a highly thermally conductive disk or plate. Preferably, the anode and envelope are immersed in an oil-based dielectric fluid which is circulated to a cooling means. In order to keep the face 16 of the anode cool, portions of the anode between the cooling fluid are highly thermally conductive.

The anode assembly A forms one end of the vacuum envelope C. A ceramic cylinder 20 is connected between the anode and an opposite or cathode end plate 22. At least an annular portion of the cylinder 20 closely adjacent to the anode is x-ray transparent to provide a window from which the x-ray beam 18 is emitted. Preferably, the cylinder 20 is constructed at least in part of a dielectric material such that the high voltage differential is maintained between the anode A and the end plate 22. In the preferred embodiment, the end plate is biased to the potential of the cathode assembly B, generally about 100–200 kV more negative than the anode A.

The cathode assembly B includes a cathode hub 30 which is rotatably mounted by a bearing means 32 relative to the cathode plate 22. The cathode cup 12 is mounted on a peripheral extension of the cathode hub. The cathode cup 12 includes a filament or other source of electrons. The cathode cup, specifically the filament, is electrically connected with a filament drive transformer assembly 34. An exterior transformer winding **34*a* is connected with a filament power supply which controls the amount of current passing through the cathode filament, hence controls the thermionic emission. A stationary transformer winding 34*b* is mounted directly across the ceramic envelope wall 20 in a magnetically coupled relationship therewith. The interior transformer winding 34*b* is electrically connected across the cathode filament. Optionally, a plurality of cathode cups or filaments may be provided. The additional cathode cups may be used for producing different types of electrode beams, such as beams with a broader or narrower focal spot, higher or lower energy beams, or the like. Also, additional cathode cups may function as a back up in case the first cup should fail or burn out. An externally controllable electronic switching circuit (not shown) can be provided between the internal transformer winding 34*b*** and the cathode cups to enable selection of which cathode cup receives the power from the transformer. Other means may also be used for transferring power to the filament such as a capacitive coupling or an annular transformer that is disposed adjacent the susceptor means E.

Figure 2:
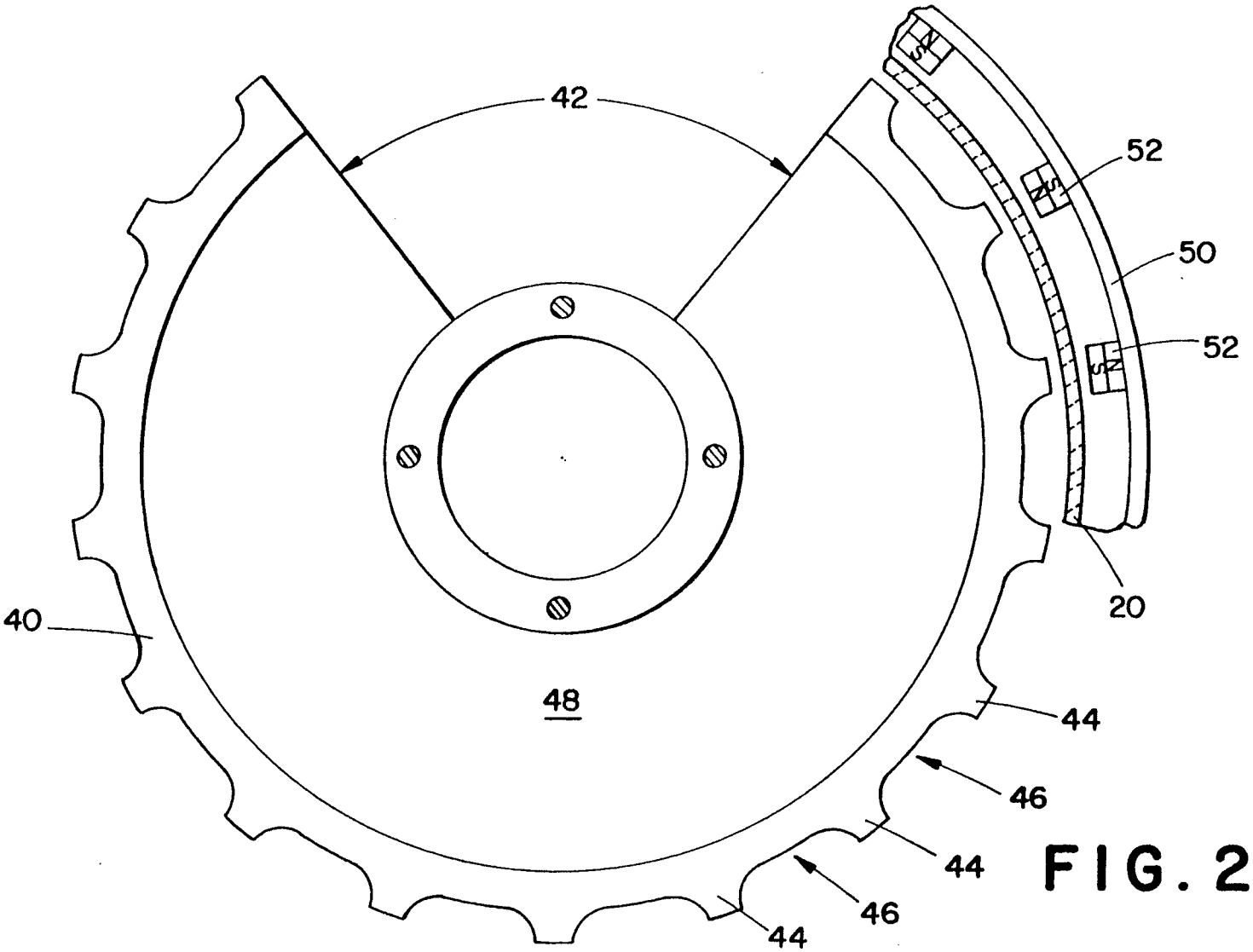
FIG. 2 is a view in partial section through section 2—2 of FIG. 1 with the transformer deleted.

With continuing reference to FIG. 1 and further reference to FIG. 2, the magnetic susceptor means E includes a susceptor 40 which follows the cylindrical inner surface of the envelope. The cylindrical contour of the susceptor may be broken out or discontinuous to accommodate other structures within the x-ray tube. For example, the susceptor has an arc segment 42 removed in order to accommodate the filament transformer 34. The susceptor has alternating teeth or projections 44 and valleys or recesses 46. The susceptor is mounted on a lever arm means such a disk portion 48 which holds the teeth portions of a magnetic susceptor at the maximum possible lever arm radius permitted by the envelope 20. The susceptor portion is constructed of a material with high magnetic susceptibility even at the elevated temperatures found in an x-ray tube.

Figure 3:
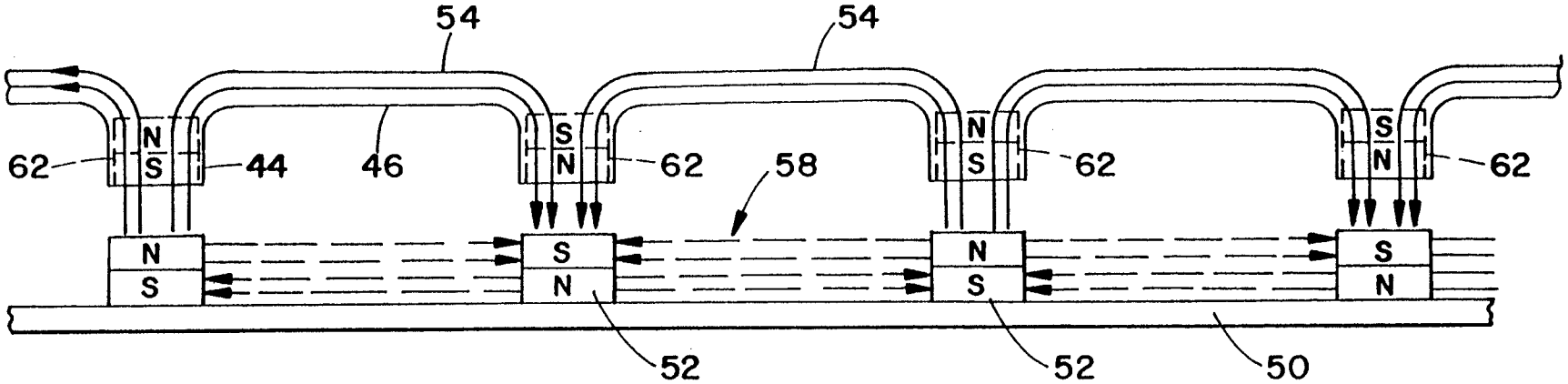
FIG. 3 illustrates magnetic flux paths through the susceptor of FIGS. 1 and 2.

A keeper or other frame structure 50 is rigidly mounted around the exterior of the envelope. A plurality of magnets 52, preferably high strength permanent magnets, are positioned opposite each of the magnetic susceptor teeth portion. Due to the higher operating temperatures associated with x-ray tubes, the magnets are constructed of a material with a high curie temperature, such as Alnico 8, neodymium-iron-boron, samarium-cobalt, or other high temperature permanent magnets. With reference to FIG. 3, the magnets 52 are mounted to the keeper 50 such that adjacent magnets have opposite polarity faces disposed towards the magnetic susceptor 40. This causes magnetic flux paths 54 to be formed through the magnetic susceptor between adjacent magnets.

Figure 6:
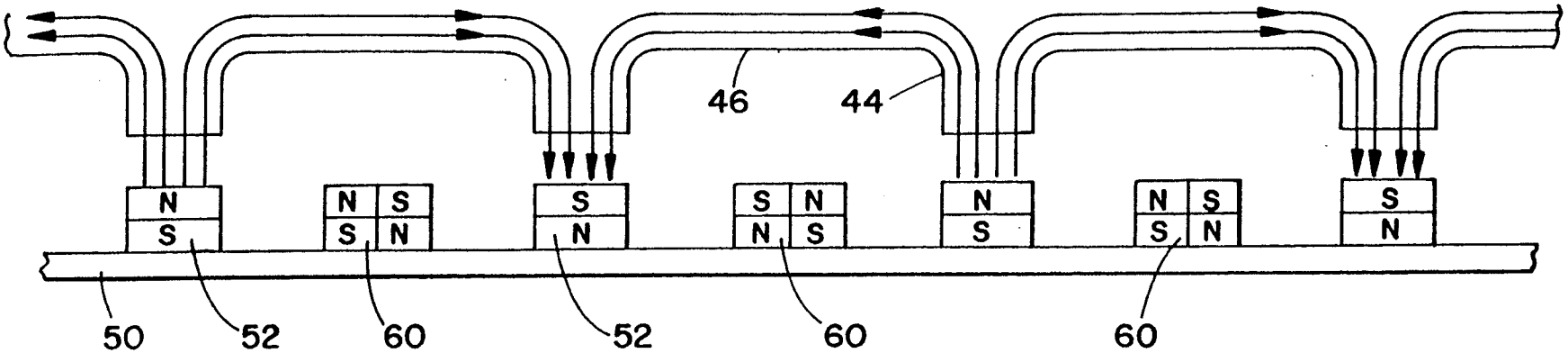
FIG. 6 is an embodiment in which blocking magnets are provided to enable the magnets to be positioned closer together.
Figure 4:
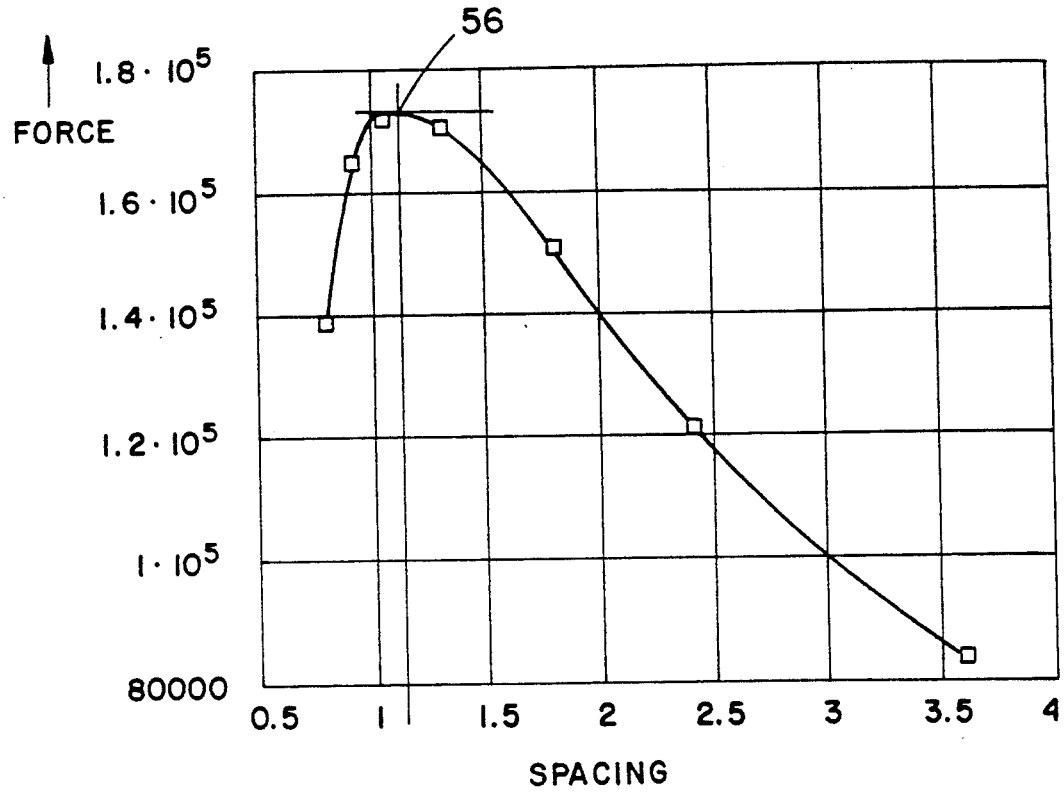
FIG. 4 is a graphic depiction of magnetic force versus magnet spacing.
Figure 5:
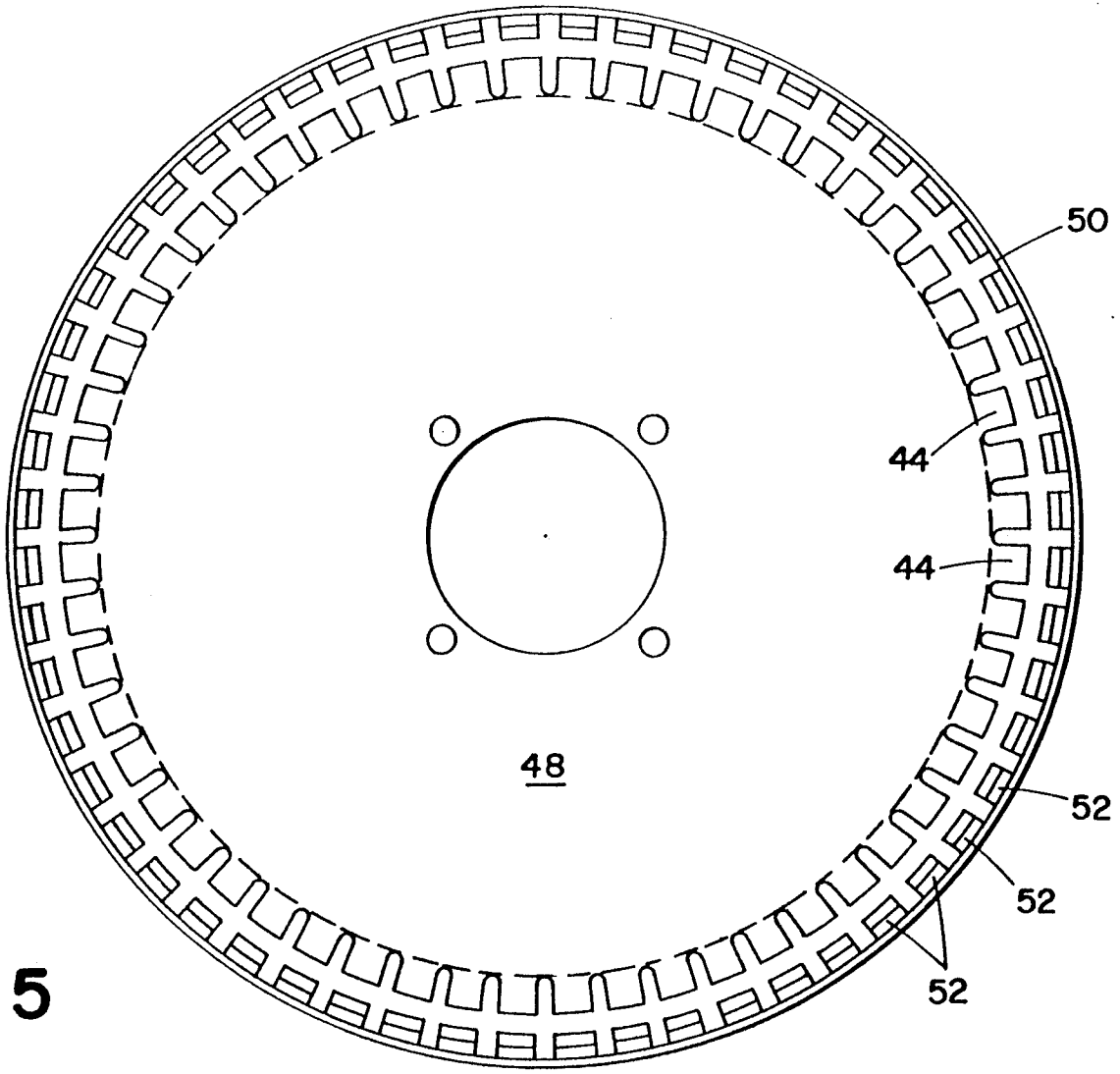
FIG. 5 is a view through section 2—2 of an alternate embodiment of the magnetic susceptor and magnet assembly.

With continuing reference to FIG. 3 and further reference to FIGS. 4 and 5, the greater the number of magnets 52 that are positioned around the susceptor, the more strongly or stiffly the cathode assembly is held in place. However, as the magnets come closer together they reach a point 56 of maximum force. Thereafter, if the magnets are positioned closer together, there is a leakage flux 58 directly between the magnets not through the receptor causing the force to drop dramatically. In one alternate embodiment of FIG. 6, this leakage flux is inhibited by disposing a blocking magnet 60 on the keeper 50 between adjacent magnets 52. The blocking magnet is positioned with four poles such that it has like poles toward with its nearest neighboring magnets.

The maximum stiffness can be obtained by maximizing the number of magnets 52 disposed on the keeper. To this end, the maximum circumference of the magnetic susceptor is divided by the magnet spacing which produces the maximum force 56. Because adjacent magnets have opposite polarity, there are preferably an even number of magnets disposed around the keeper 50. To this end, it is preferred that the number of magnets obtained by dividing the circumference by the minimum spacing be rounded down to the nearest even whole integer.

In accordance with another aspect of the present invention, the teeth portions 44 of the magnetic susceptor are constructed at least in part of Alnico 8, neodymium-iron-boron, samarium-cobalt, or other high temperature permanent magnets 62. The magnets in each tooth have a polarity which presents an opposite pole to the pole to the most closely adjacent stationary magnet 52.

Figure 7:
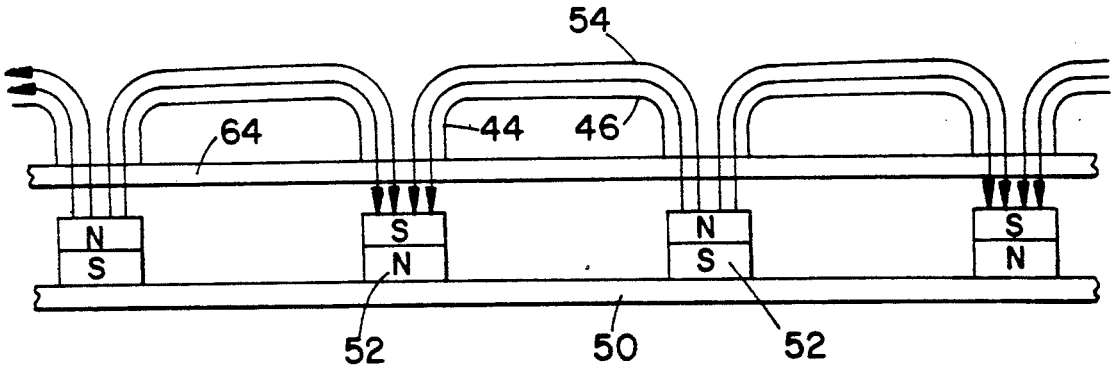
FIG. 7 is an alternate embodiment in which the oscillation damping means includes eddy current braking.

Even although the stiffness of the magnetic connection is optimized, there may still be oscillation problems. Even a stiff spring oscillates. With reference to FIG. 7, one means for braking or damping oscillation includes an electrically conductive, magnetically non-susceptive layer 64 disposed around all or portions of the magnetic susceptor. Motion of the magnetic susceptor relative to the magnets 52 causes the generation of eddy currents in the electrically conductive layer 64, which eddy currents generate magnetic fields which oppose the most nearly adjacent magnet. This magnetic opposition produces a force which acts against the susceptor and magnets moving out of alignment.

Figure 8:
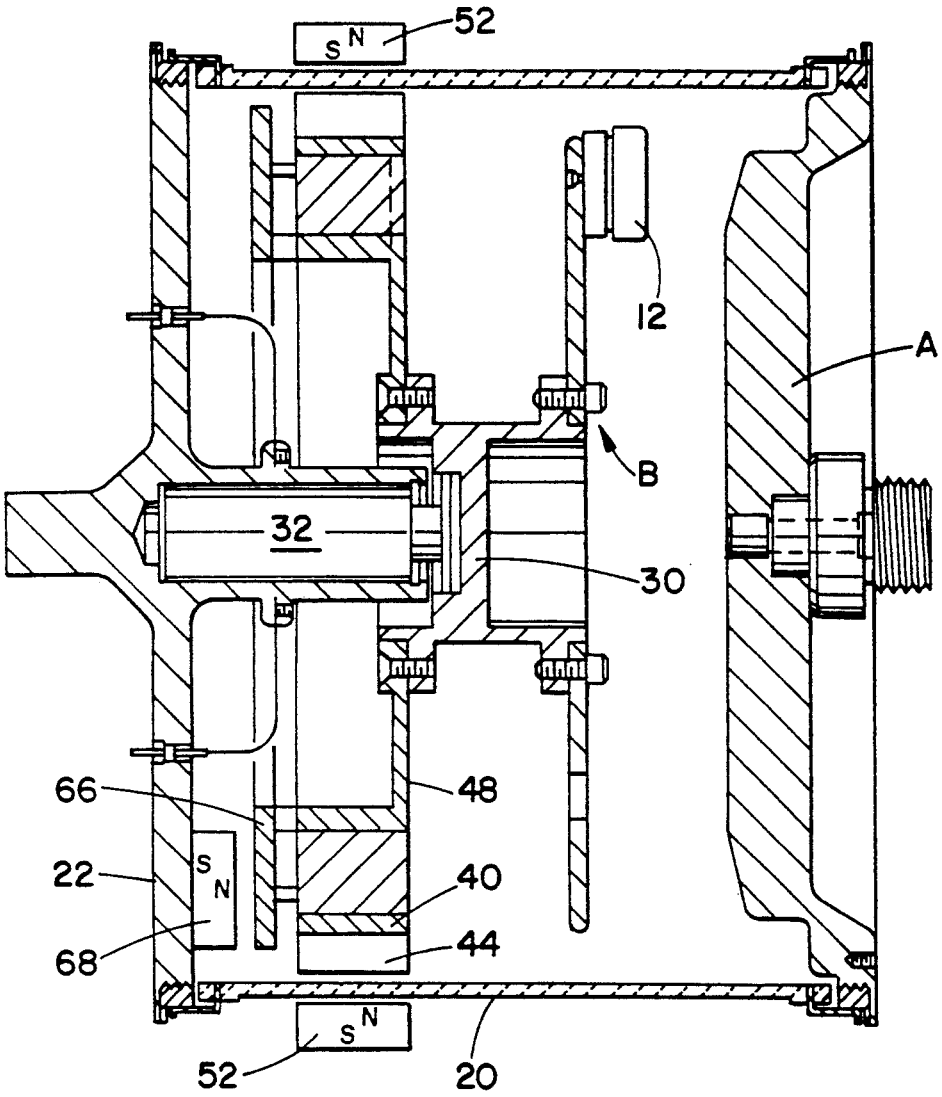
FIG. 8 is an alternate embodiment in which the damping means includes an induction drag arrangement; and, FIG. 9 is an alternate embodiment with an active oscillation damping means.

With reference to FIG. 8, another means for damping oscillation includes a means for imparting a torque on the cathode assembly. This is analogous to applying a force which tends to stretch a spring in a fixed direction. This rotational torque can be applied in various ways. For example, the bearing 32 may be constructed to have sufficient drag that a small torque is applied which tends to cock the cathode assembly very slightly moving the teeth portions of the magnetic susceptor very slightly out of optimal alignment with the magnets 52. Another means for damping oscillation includes an electrically conductive disk 66 mounted to the cathode assembly and a magnet 68 to the envelope. As the magnet rotates, it induces eddy currents in the electrically conductive disk 66 creating a force or drag which tries to rotate the disk with the magnet. The size of the magnet is selected such that the cathode is cocked only a small amount, but not rotated with the envelope. Of course, the disk may rotate with the housing or even be a portion of the cathode plate 22 and the magnet may be connected to and remain stationary with the cathode assembly. In this manner, the slight cocking or shift of the toothed magnetic susceptor relative to the outside magnets damps unwanted oscillations.

Figure 9:
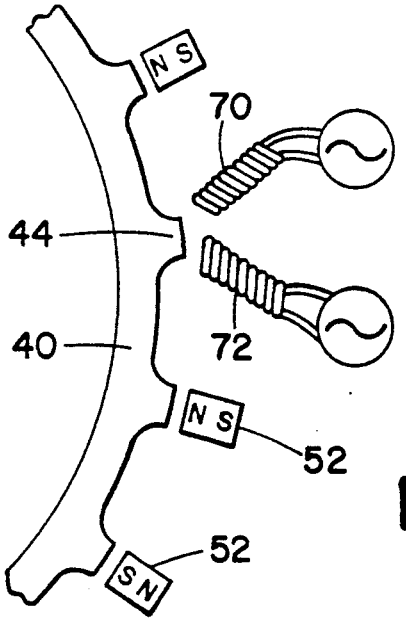

With reference to FIG. 9, an active oscillation damping system is also contemplated. In this embodiment, a pair of electromagnets 70, 72 are supplied with alternating current. The two electromagnets are positioned with one slightly clockwise and the other slightly counterclockwise from one of the magnetic susceptor teeth 44. The electromagnets are sufficiently close to the tooth that the magnetic susceptibility of the susceptor affects the resonance frequency of the coils. Moving the magnetic susceptor closer to or further from the coils changes their respective resonance frequencies. The frequency of the current supplied to the coils is off-resonance, preferably slightly below resonance. As the susceptor tooth projection approaches one of the electromagnets, its selfinductance is increased and the current flowing through the coil is decreased. That is, as one of the tooth portions moves towards the magnet, its magnetic force or pull decreases. Analogously, as the tooth portion moves away from the other electromagnet, its self-inductance is decreased, increasing the amount of current flowing through that coil and increasing the force with which it pulls the tooth portion to return to its original position. In this manner, the electromagnets actively damp oscillation.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. An x-ray tube comprising:

an evacuated envelope;

an anode formed at least along an annular surface adjacent one end of the envelope, the envelope and anode being interconnected;

a cathode assembly rotatably supported relative to and within the envelope, the cathode assembly including a cathode means for emitting electrons for forming an electron beam which strikes the anode to generate x-rays;

a means for rotating the envelope and anode;

a means for holding the cathode assembly stationary as the envelope and anode rotate, the means for holding the cathode assembly stationary including:

a magnetic susceptor mounted to the cathode assembly and defining a plurality of outward projections which are disposed closely adjacent the envelope, the magnetic susceptor being constructed of a magnetically susceptive material, a plurality of magnets mounted to a stationary keeper, the magnets being disposed peripherally around an exterior of and closely adjacent to the envelope with each of the magnets generally opposite to one of the susceptor projections.

2. The x-ray tube as set forth in claim 1 further including a means for damping oscillation of the susceptor and cathode assembly relative to the stationary magnets.

3. The x-ray tube as set forth in claim 2 wherein the damping means includes an electrically conductive, minimally magnetically susceptive material disposed adjacent each of the susceptor projections such that movement of the susceptor relative to the stationary magnets induces eddy currents within the magnetically conductive material, which eddy currents interact with the stationary magnets to create a force which damps movement.

4. The x-ray tube as set forth in claim 2 wherein the damping means includes an electrically conductive disk and magnetic assembly, one of the electrically conductive disk and magnet being connected with the envelope for rotation therewith and the other being connected with the susceptor and cathode assembly, such that as the envelope rotates relative to the cathode assembly, the magnet induces eddy currents in the disk which exerts a rotational force on the cathode assembly.

5. The x-ray tube as set forth in claim 2 wherein the damping means includes a pair of electromagnetic coils disposed adjacent a magnetically susceptive portion of the susceptor and cathode assembly, the electromagnetic coils being disposed sufficiently adjacent the magnetically susceptive portion that the magnetically susceptive portion affects a resonance frequency of the coil, a current supply means for supplying oscillating current near but offset from a resonance frequency of the coils such that as the susceptor moves closer to one of the coils, its self-inductance increases and the magnetic force with which it attracts the magnetically susceptive material decreases and such that as the magnetically susceptive projection moves away from the other coil, the self-inductance of the other coil decreases and the magnetic force with which the other coil attracts the magnetic susceptive portion increases.

6. The x-ray tube as set forth in claim 1 wherein the plurality of magnets are mounted with alternating poles disposed toward the susceptor projections.

7. The x-ray tube as set forth in claim 1 wherein the stationary magnets have alternate poles facing the magnetic susceptor projections and further including a magnet disposed between each magnet pair and oriented such that a shorting of magnetic flux between adjacent magnets through air rather than through the magnetic susceptor is inhibited.

8. The x-ray tube as set forth in claim 1 further including permanent magnets mounted in the magnetic susceptor projections.

9. The x-ray tube as set forth in claim 1 further including a plurality of permanent magnets mounted along the electrical magnetic susceptor.

10. An x-ray tube comprising:

an evacuated envelope;

an anode formed at least along an annular surface adjacent one end of the envelope, the envelope and anode being interconnected;

a cathode assembly rotatably supported relative to and within the envelope, the cathode assembly including a cathode means for emitting electrons for forming an electron beam which irradiates the anode to generate x-rays;

a means for rotating the envelope and anode;

a means for holding the cathode assembly stationary as the envelope and anode rotate including a magnetic susceptor means and a magnetic means, one of the magnetic susceptor means and magnet means being mounted to the cathode assembly and the other being mounted peripherally around an exterior of and closely adjacent to the envelope in magnetic communication with each other; and a means for damping oscillation of the cathode assembly.

11. The x-ray tube as set forth in claim 10 wherein the damping means includes an electrically conductive, minimally magnetically susceptive material disposed adjacent the susceptor means such that movement of the susceptor means relative to the magnets induces eddy currents within the magnetically conductive material, which eddy currents interact with the magnets to create a force which damps movement.

12. The x-ray tube as set forth in claim 10 wherein the damping means includes an electrically conductive disk and magnetic assembly, one of the electrically conductive disk and magnet being connected with the envelope for rotation therewith and the other being connected with the cathode assembly, such that as the envelope rotates relative to the cathode assembly, the magnet induces eddy currents in the disk which exerts a rotational force on the cathode assembly.

13. The x-ray tube as set forth in claim 10 wherein the damping means includes a pair of electromagnetic coils disposed adjacent the susceptor means, the electromagnetic coils being disposed adjacent the susceptor means such that the magnet susceptor means affects a resonance frequency of the coil, a current supply for supplying oscillating current near but offset from a resonance frequency of the coils such that as the susceptor means moves closer to one of the coils, its self-inductance increases and the magnetic force with which it attracts the magnetically susceptive material decreases and such that as the magnet susceptor means moves away from the other coil, the self-inductance of the other coil decreases and the magnetic force with which the other coil attracts the susceptor means increases.

14. The x-ray tube as set forth in claim 10 wherein the magnet means includes a plurality of magnets are mounted with alternating poles disposed toward the susceptor means.

15. The x-ray tube as set forth in claim 14 wherein the plurality of magnets are mounted outside the envelope and the magnetic susceptor means is mounted in the envelope to the cathode assembly.

16. The x-ray tube as set forth in claim 14 wherein the susceptor means includes a plurality of permanent magnets mounted opposite the plurality of magnets of the magnet means.

17. The x-ray tube as set forth in claim 14 wherein the susceptor means includes a generally cylindrical portion with an outward projecting tooth adjacent each of the permanent magnets.

* * * * *